US008684087B1

(12) United States Patent
Lopez

(10) Patent No.: US 8,684,087 B1
(45) Date of Patent: Apr. 1, 2014

(54) DOWNHOLE FLOW CONTROL USING PERFORATOR AND MEMBRANE

(71) Applicant: Halliburton Energy Services, Inc., Houston, TX (US)

(72) Inventor: Jean-Marc Lopez, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/944,364

(22) Filed: Jul. 17, 2013

Related U.S. Application Data

(63) Continuation of application No. PCT/US2012/058584, filed on Oct. 4, 2012.

(51) Int. Cl.
*E21B 34/14* (2006.01)
*E21B 33/10* (2006.01)

(52) U.S. Cl.
USPC ..... 166/317; 166/373

(58) Field of Classification Search
USPC ..... 166/317, 154, 153, 373, 376; 137/68.11
See application file for complete search history.

(56) References Cited

U.S. PATENT DOCUMENTS

| | | | | |
|---|---|---|---|---|
| 3,586,104 | A | 6/1971 | Hyde | |
| 5,004,007 | A | 4/1991 | Johnson et al. | |
| 7,360,602 | B2 | 4/2008 | Kritzler et al. | |
| 7,849,925 | B2 | 12/2010 | Patel | |
| 8,225,874 | B2 | 7/2012 | Messick et al. | |
| 2010/0108326 | A1 | 5/2010 | Messick et al. | |
| 2010/0212907 | A1* | 8/2010 | Frazier | 166/317 |
| 2012/0037360 | A1 | 2/2012 | Arizmendi, Jr. et al. | |
| 2012/0138311 | A1* | 6/2012 | Stout | 166/373 |
| 2012/0285702 | A1* | 11/2012 | Rytlewski | 166/373 |

OTHER PUBLICATIONS

International Patent Application No. PCT/US2012/058584 , "International Search Report and Written Opinion", mailed Apr. 16, 2013 (11 pages).

* cited by examiner

*Primary Examiner* — Daniel P Stephenson
(74) *Attorney, Agent, or Firm* — Kilpatrick Townsend & Stockton LLP

(57) ABSTRACT

A flow control assembly can be disposed in a wellbore and can include a membrane that can be perforated in response to a pressure, such as a setting pressure, from an inner area of a tubing. Subsequent to the membrane being perforated, fluid can be allowed to flow from an area external to the tubing to an area internal to the tubing. The membrane may remain closed during a packer setting operation and be perforated subsequent to the packer setting operation.

15 Claims, 6 Drawing Sheets

DOWNHOLE FLOW CONTROL USING PERFORATOR AND MEMBRANE

CROSS-REFERENCE TO RELATED APPLICATIONS

This is a continuation of PCT/US2012/058584, filed Oct. 4, 2012, the entirety of which is incorporated herein by reference.

TECHNICAL FIELD OF THE INVENTION

The present invention relates generally to assemblies for controlling fluid flow in a bore in a subterranean formation and, more particularly (although not necessarily exclusively), to assemblies that include membranes that can be perforated in response to pressure to allow fluid flow.

BACKGROUND

Various devices can be installed in a well traversing a hydrocarbon-bearing subterranean formation. Some devices control the flow rate of fluid between the formation and tubing, such as production or injection tubing. An example of these devices is a flow control device or inflow control device that can be associated with a production interval isolated by packers and that can control production of fluid by creating a pressure drop of fluid flowing through the device.

A completion assembly can be ran downhole with a packer. Pressure can be introduced in the tubing to set the packer. Subsequent to setting the packer, openings or ports in the assembly can be created for fluid production.

Some assemblies include components that facilitate or allow creation of ports for fluid production. For example, an assembly can include openings plugged with aluminum or polylactic acid (PLA) that can dissolve on exposure to acid introduced into the bore (in the case of aluminum) or to an environment of the bore (in the case of PLA). PLA plugs, however, may be unable to withstand pressure above a certain threshold.

Assemblies are desirable, however, that can allow for relatively high pressure to set a packer and then allow for fluid flow control.

SUMMARY

Certain aspects of the present invention are directed to a flow control assembly that can provide a pressure seal during a packer setting operation and allow fluid flow subsequent to a membrane being perforated in response to a setting pressure from an inner area of a tubing.

One aspect relates to a flow control assembly that can be disposed in a wellbore. The flow control assembly includes a membrane and a perforator. The membrane can provide a pressure seal and prevent fluid flow in the flow control assembly. The perforator can perforate the membrane in response to a setting pressure in the flow control assembly exceeding a threshold. The perforated member can provide a fluid flow path in the flow control assembly.

Another aspect relates to a flow control assembly that includes a membrane, a perforator, and a piston. The membrane can provide a pressure seal and prevent fluid flow in the flow control assembly. The piston can cause at least one of the perforator or the membrane to move in response to pressure from an inner area of a tubing. The perforator can create a flow path through the membrane in response to movement of the perforator or the membrane.

Another aspect relates to an assembly that includes a tubing portion, an outer housing, a perforator, a membrane, and a piston. The tubing portion has a tubing port that can allow access of pressure from an internal area of the tubing portion to an external area. The outer housing is external to the tubing portion having the tubing port. The outer housing includes a housing opening and defines a flow path between the outer housing and the tubing port. The perforator is disposed in the flow path in a fixed position. The membrane is disposed in the flow path. The membrane can provide a pressure seal and pressure fluid flow in the flow path in response to a packer setting pressure. The piston is disposed in the flow path and coupled to the membrane. The piston can allow the membrane to move toward the perforator in response to the pressure being above a threshold. The perforator can perforate the membrane in response to the membrane moving toward the perforator. The perforated membrane can allow fluid flow through the flow path.

These illustrative aspects and features are mentioned not to limit or define the invention, but to provide examples to aid understanding of the inventive concepts disclosed in this disclosure. Other aspects, advantages, and features of the present invention will become apparent after review of the entire disclosure.

DETAILED DESCRIPTION

Certain aspects and features relate to a flow control assembly that includes a membrane that can be perforated in response to a pressure, such as a setting pressure, from an inner area of a tubing. Subsequent to the membrane being perforated, fluid can be allowed to flow from an area external to the tubing to an area internal to the tubing. The membrane may remain closed during a packer setting operation and be perforated subsequent to the packer setting operation.

In some aspects, the flow control assembly includes a perforator, a piston, and a membrane. The piston can allow at least one of the perforator or the membrane to move in response to a pressure above a certain threshold. The movement can result in the membrane being perforated by the perforator. After the pressure is released, the piston can allow the perforator and/or the membrane to move to an open position, allowing fluid to flow to an inner area of a tubing through a tubing port.

In another aspect, the flow control assembly includes a spring that can cause the piston to allow the perforator and/or the membrane to move to the open position subsequent to perforation of the membrane.

These illustrative aspects and examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present invention.

Figure 1:
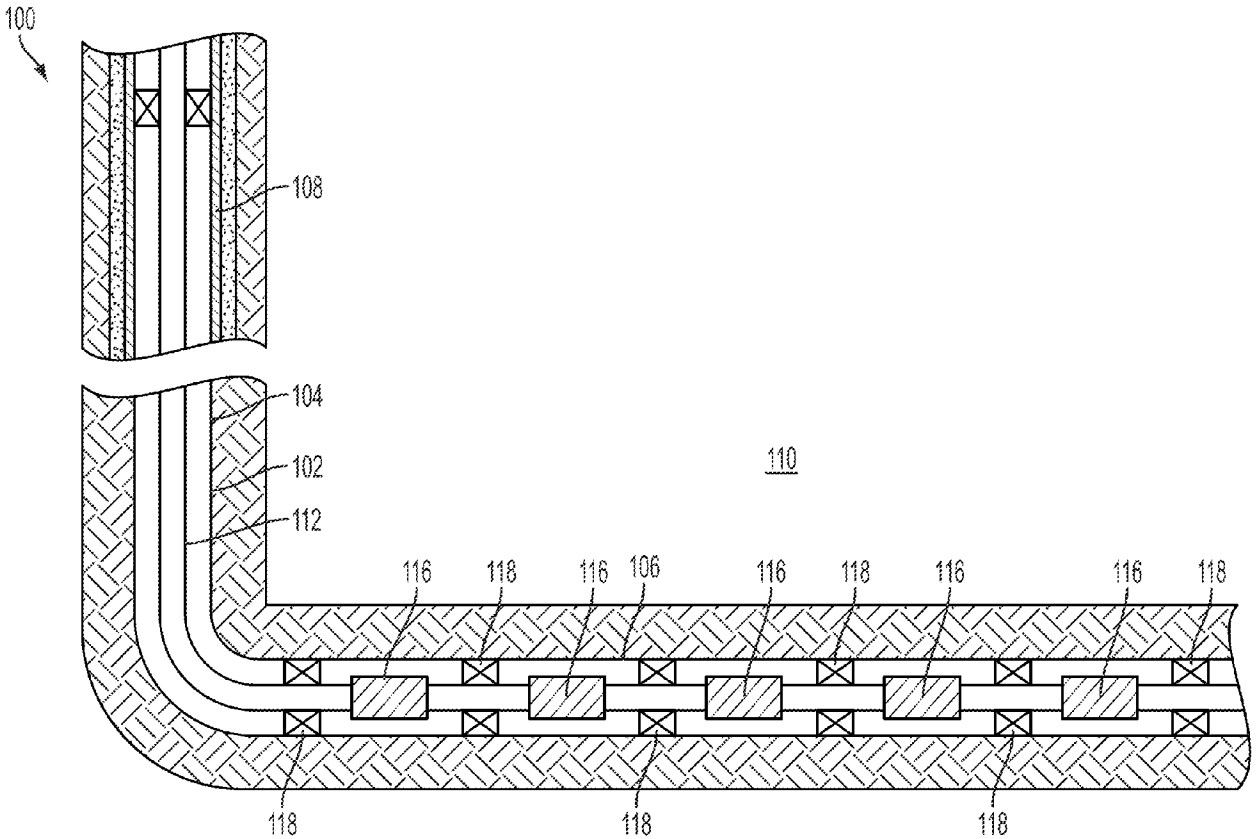
FIG. 1 is a schematic illustration of a well system having production intervals in which are flow control assemblies according to one aspect of the present invention.

FIG. 1 depicts a well system 100 with flow control assemblies according to certain aspects of the present invention. The well system 100 includes a bore that is a wellbore 102 extending through various earth strata. The wellbore 102 has a substantially vertical section 104 and a substantially horizontal section 106. The substantially vertical section 104 and the substantially horizontal section 106 may include a casing string 108 cemented at an upper portion of the substantially vertical section 104. The substantially horizontal section 106 extends through a hydrocarbon bearing subterranean formation 110.

A tubing string 112 extends from the surface within wellbore 102. The tubing string 112 can provide a conduit for formation fluids to travel from the substantially horizontal section 106 to the surface. Production tubular sections 116 in various production intervals adjacent to the formation 110 are positioned in the tubing string 112. On each side of each production tubular section 116 is a packer 118 that can provide a fluid seal between the tubing string 112 and the wall of the wellbore 102. Each pair of adjacent packers 118 can define a production interval.

One or more of the production tubular sections 116 can include a flow control assembly. The flow control assembly can include one or more ports in the tubing string 112 and a membrane that can be perforated in response to a pressure to create a flow path, which may include the ports in the tubing string.

Although FIG. 1 depicts production tubular sections 116 that can include flow control assemblies positioned in the substantially horizontal section 106, production tubular sections 116 (and flow control assemblies) according to various aspects of the present invention can be located, additionally or alternatively, in the substantially vertical section 104. Furthermore, any number of production tubular sections 116 with flow control assemblies, including one, can be used in the well system 100 generally or in each production interval. In some aspects, production tubular sections 116 with flow control assemblies can be disposed in simpler wellbores, such as wellbores having only a substantially vertical section. Flow control assemblies can be disposed in open hole environments, such as is depicted in FIG. 1, or in cased wells.

Figure 2:
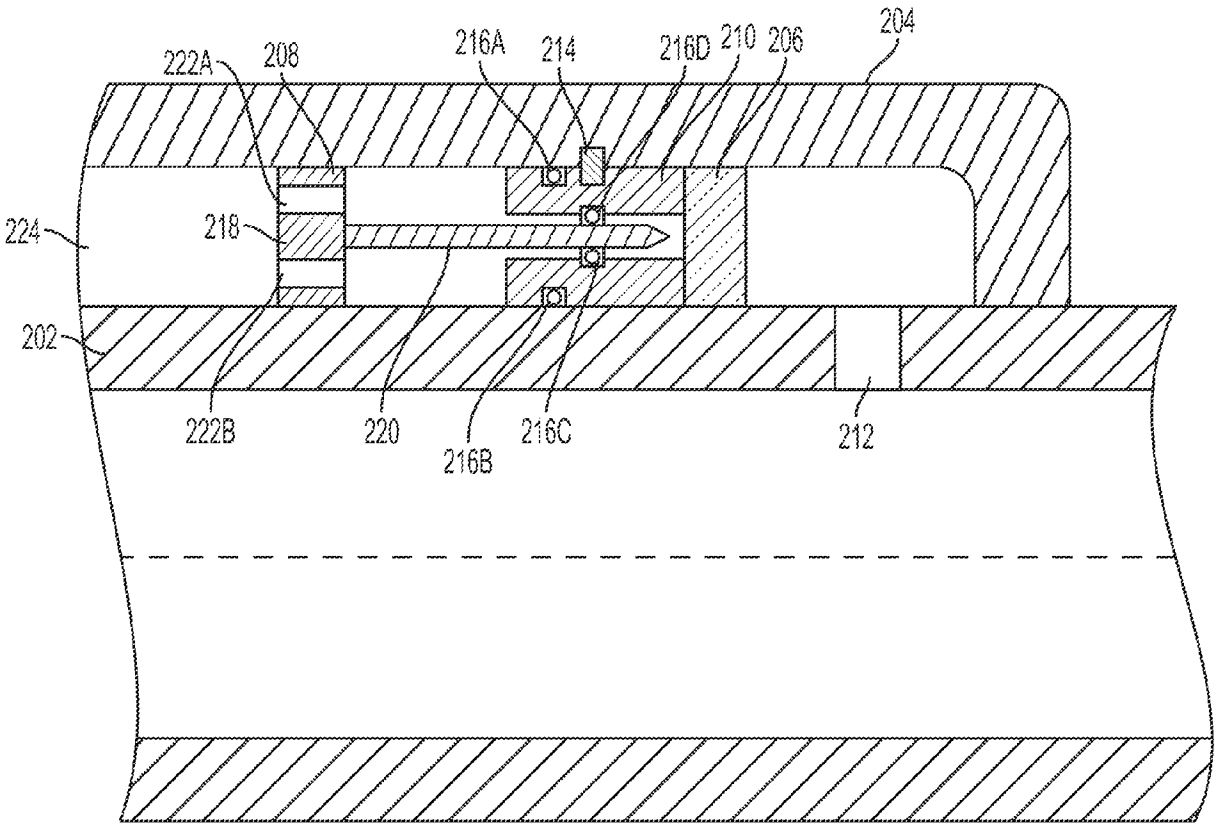
FIG. 2 is a cross-sectional view of a flow control assembly that includes a perforator and a membrane according to one aspect of the present invention.
Figure 3:
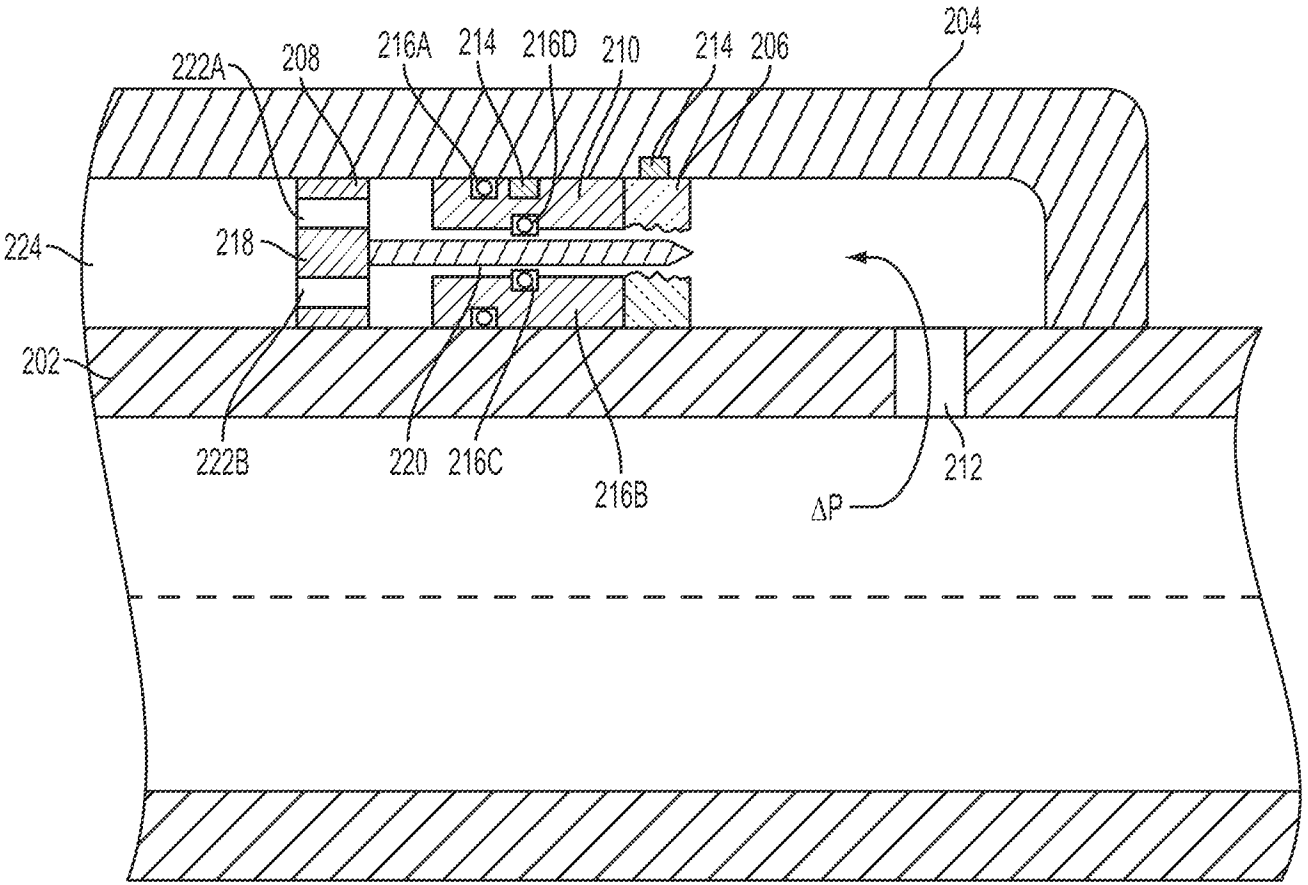
FIG. 3 is a cross-sectional view of the flow control assembly of FIG. 2 subsequent to perforation of the membrane according to one aspect of the present invention.

FIGS. 2-3 depict by cross-section a flow control assembly according to one aspect. The flow control assembly includes a tubing portion 202 and an outer housing 204. The flow control assembly also includes a membrane 206, a perforator 208, and a piston 210 that are between an outer wall of the tubing portion 202 and an inner wall of the outer housing 204.

The tubing portion 202 includes a tubing port 212 that can allow fluid to flow between an inner area of the tubing portion 202 and an outer area of the tubing portion 202. The tubing port 212 may also allow pressure access between the inner area of the tubing portion 202 and the outer area of the tubing portion 202.

The piston 210 may be made from any material. An example of material from which piston 210 can be made is stainless steel. The piston 210 can be coupled to the outer housing 204 by a shear mechanism 214. An example of a shear mechanism 214 is a shear pin. Included with the piston 210 are sealing members 216A-D. An example of a sealing member is an O-ring. Although four sealing members are depicted, any number, including one, can be used. Other aspects do not include sealing members.

The perforator 208 can include a base 218 and an elongated member 220 extending from the base 218. The elongated member 220 may have a pointed end that can perforate the membrane 206. The base 218 can be coupled to the outer housing 204 such that the perforator 208 is fixed in position within the outer housing 204. The base 218 includes openings 222A-B through which fluid can flow from a housing opening toward the tubing port 212. Bases according to various aspects can include any number of openings, including one. The perforator 208 can be made from any material. An example of material is tungsten carbide. In some aspects, the elongated member 220 is made from a material such as tungsten carbide and the base 218 is made from a different material such as steel.

The membrane 206 can be coupled to the piston 210. In some aspects, the membrane 206 and piston 210 are one component made from the same material. An example of membrane 206 is a ceramic disc.

The membrane 206 in a closed position, as shown in FIG. 2, can prevent fluid from flowing from a housing opening 224 to the tubing port 212. For example, the membrane 206 may prevent fluid flow during a packer setting operation or other operation. The piston 210 can prevent the membrane 206 from being perforated in response to pressure during the packer setting operation. A setting pressure above a certain threshold can be applied through the inner area of the tubing portion 202 and the tubing port 212 to an external area of the tubing portion 202 in the outer housing 204. The setting pressure is depicted as "ΔP" in FIG. 3. In response to the pressure, the piston 210 can allow the membrane 206 to move toward the perforator 208, as shown in FIG. 3. The shear mechanism 214 can be sheared such that at least part of the piston 210 is decoupled from the outer housing 204. The perforator 208 can perforate the membrane 206 in response to the movement of the membrane 206 toward the perforator 208.

For example, the elongated member 220 can break the membrane 206 or otherwise create an opening in the membrane 206. Sealing members 216A-D can retain pressure within the tubing portion 202 to allow other flow control assemblies in the wellbore to be opened using pressure from within tubing of which the tubing portion 202 is a part. Subsequently, such as after the pressure from within the tubing is removed, fluid flow or pressure from the housing opening 224 can cause the piston 210 to allow the membrane 206 to move away from the perforator 208 to a position that allows fluid flow from the housing opening 224 to the tubing port 212. For example, force or pressure from production fluid flowing through openings 222A-B can cause the piston 210 to allow the membrane 206 to move away from the perforator 208, creating a flow path for fluid flow through the outer housing 204 and the tubing port 212 into the inner area of the tubing portion 202.

Figure 4:
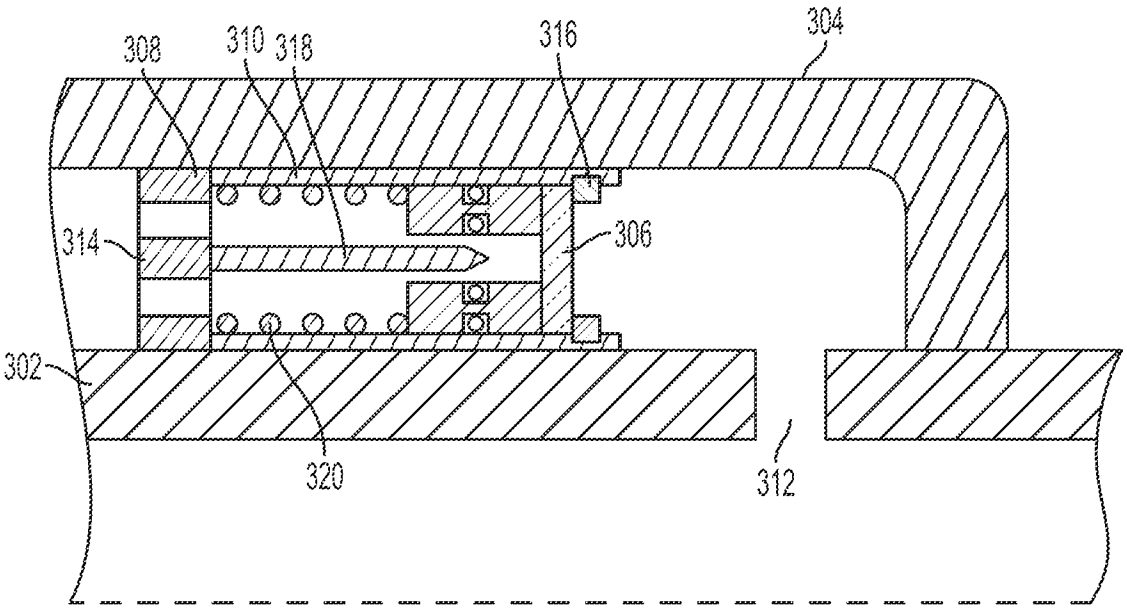
FIG. 4 is a partial cross-sectional view of a flow control assembly according to another aspect of the present invention.
Figure 5:
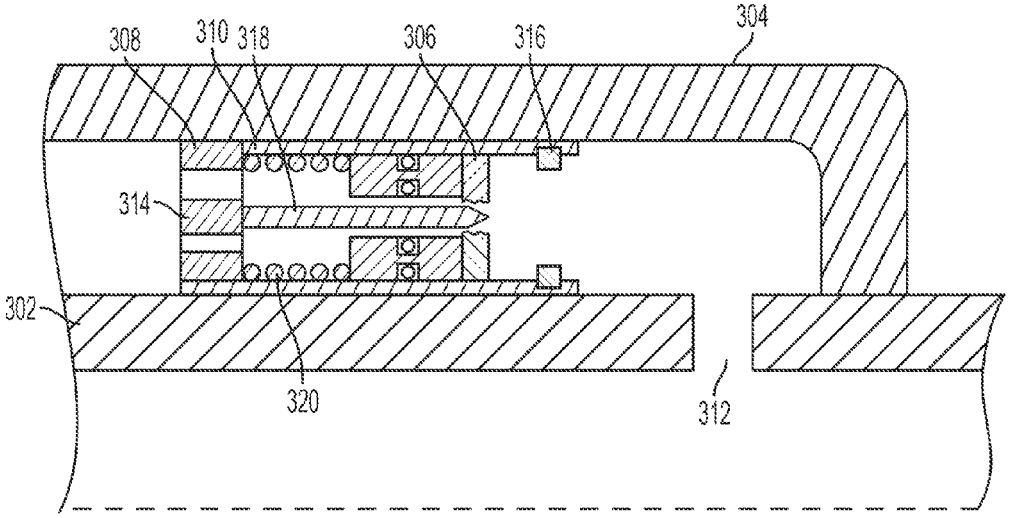
FIG. 5 is a partial cross-sectional view of the flow control assembly of FIG. 4 subsequent to perforation of the membrane according to one aspect of the present invention.
Figure 6:
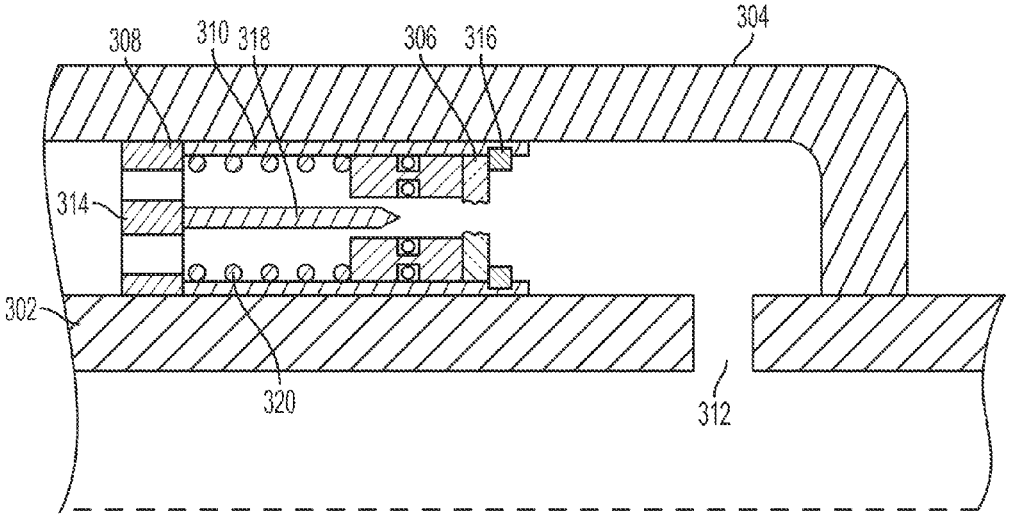
FIG. 6 is a partial cross-sectional view of the flow control assembly of FIG. 4 in an open flow position according to one aspect of the present invention.

Flow control assemblies according to some aspects can include mechanisms that can facilitate creation of a flow path subsequent to a membrane being perforated. FIGS. 4-6 depict by partial cross-section a flow control assembly according to another aspect. The flow control assembly includes a tubing portion 302, an outer housing, 304, a membrane 306, a perforator 308, and a piston 310. The tubing portion 302 includes a tubing port 312. The piston 310 extends from a base 314 of the perforator 308 toward the tubing port 312 and includes a stop member 316. The stop member 316 can prevent the membrane 306 from moving toward the tubing port 312 beyond a certain point. The perforator 308 also includes an elongated member 318 extending from the base 314 toward the membrane 306. The base 314 can be coupled to the outer housing 304 such that the perforator 308 is in a fixed position.

The flow control assembly also includes a mechanism that is a spring 320 between the base 314 and a movable portion of the piston 310. As shown in FIG. 4, the spring 320 can bias the piston 310 and the membrane 306 toward the tubing port 312 such that the membrane 306 contacts the stop member 316. In response to pressure from an inner area of the tubing portion 302, the piston 310 can allow the membrane 306 to move toward the perforator 308 and overcome the biasing force of the spring 320. The elongated member 318 can perforate the membrane 306 to create an opening in the membrane 306, as shown in FIG. 5. The opening can be part of flow path from an opening of the outer housing 304 through the tubing port 312 to the inner area of the tubing portion 302.

Subsequent to perforation of the membrane 306, the spring 320 can bias the moveable portion of the piston 310 and any remainder part of the membrane 306 to the stop member 316 such that the flow control assembly is in a full open position, as shown in FIG. 6. In a full open position, fluid can flow through the flow control assembly, including the tubing port 312, without significant restriction. The spring 320 can basis the moveable portion of the piston 310 and any remainder part of the membrane 306 to the stop member 316 even if pressure from fluid from an opening of the outer housing 304 is insufficient to move the piston 310 and the membrane 306.

Figure 7:
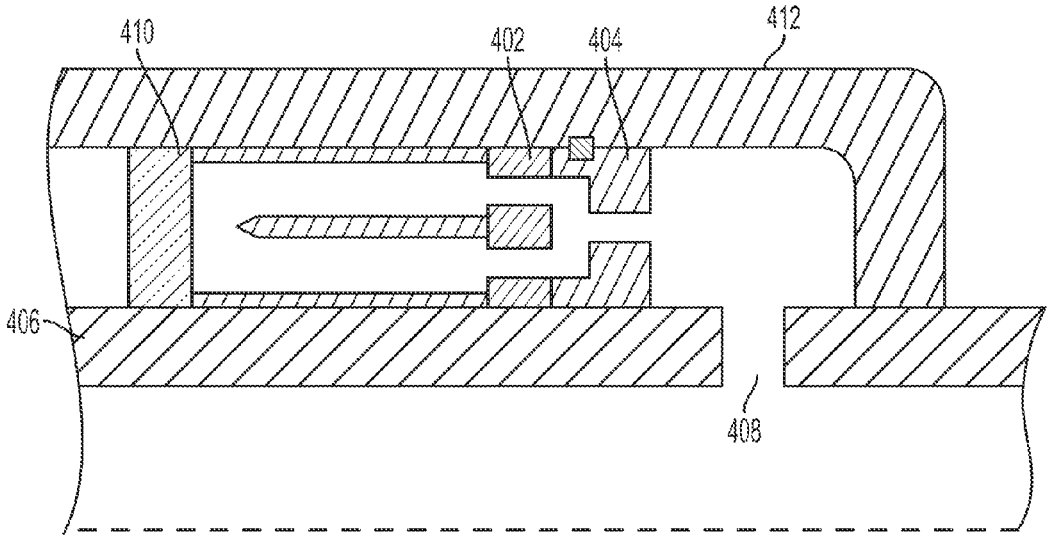
FIG. 7 is a partial cross-sectional view of a flow control assembly according to yet another aspect of the present invention.

FIG. 7 depicts another aspect of a flow control assembly in which a perforator 402 is coupled to a piston 404, and can move in response to pressure from an inner area of a tubing portion 406 through a tubing port 408 to perforate a membrane 410 that is coupled to an outer housing 412. For example, the membrane 410 may be in a fixed position and the piston 404 can allow the perforator 402 to move in response to pressure above a certain threshold. In still other aspects, both the perforator 402 and the membrane 410 can move in response to pressure or the absence of pressure, as the case may be.

The foregoing description of the aspects, including illustrated aspects, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. A flow control assembly configured for being disposed in a wellbore, the flow control assembly comprising:

a membrane configured for providing a pressure seal and preventing fluid flow in the flow control assembly;

a perforator for perforating the membrane in response to a setting pressure in the flow control assembly exceeding a threshold, wherein the perforated member is configured for providing an fluid flow path in the flow control assembly; and a piston that is moveable in response to the setting pressure for allowing the perforator to perforate the membrane, wherein the piston is coupled to the membrane, the membrane being moveable with the piston in response to the setting pressure, the perforator being configured to be in a fixed position with respect to the membrane.

2. The flow control assembly of claim 1, further comprising:

a spring member configured for moving the piston away from the perforator subsequent to the perforator perforating the membrane.

3. The flow control assembly of claim 1, further comprising:

a tubing portion having a tubing port configured to provide fluid communication between an inner area defined by the tubing portion and an area external to the tubing portion;

an outer housing external to the tubing portion and comprising a housing opening, the perforator and the membrane being disposed in the outer housing between the housing opening and the tubing port, wherein the perforator comprises:

a base coupled to the outer housing, the base comprising a base opening configured to allow fluid to flow from the housing opening toward the tubing port; and an elongated member extending from the base toward the membrane.

4. The flow control assembly of claim 3, further comprising a spring member disposed between part of a piston and at least one of the base or the membrane.

5. The flow control assembly of claim 3, further comprising:

a shear pin coupling a piston to the outer housing prior to the perforator perforating the membrane; and at least one sealing member configured for preventing pressure equalization in the outer housing and for allowing a second flow control assembly to be set.

6. The flow control assembly of claim 1, wherein the setting pressure is configured to be subsequent to a packer setting pressure introduced into the wellbore, the perforator being configured to avoid penetrating the membrane in response to the packer setting pressure.

7. A flow control assembly, comprising:

a membrane configured for providing a pressure seal and preventing fluid flow in the flow control assembly;

a perforator; and a piston for causing at least one of the perforator or the membrane to move in response to pressure from an inner area of a tubing, the perforator being configured to create a flow path through the membrane in response to movement of the perforator or the membrane, wherein the piston is coupled to the membrane, the membrane being moveable with the piston in response to the pressure, the perforator being configured to be in a fixed position with respect to the membrane.

8. The flow control assembly of claim 7, further comprising:

a spring member configured for moving the piston away from the perforator subsequent to the perforator perforating the membrane.

9. The flow control assembly of claim 7, further comprising:

a tubing portion having a tubing port configured to provide fluid communication between the inner area defined by the tubing portion and an area external to the tubing portion;

an outer housing external to the tubing portion and comprising a housing opening, the perforator and the membrane being disposed in the outer housing between the housing opening and the tubing port, wherein the perforator comprises:

a base coupled to the outer housing, the base comprising a base opening configured to allow fluid to flow from the housing opening toward the tubing port; and an elongated member extending from the base toward the membrane.

10. The flow control assembly of claim 9, further comprising:

a shear pin coupling the piston to the outer housing prior to the perforator perforating the membrane; and at least one sealing member configured for preventing pressure equalization in the outer housing and for allowing a second flow control assembly to be set.

11. The flow control assembly of claim 9, wherein the pressure is configured to be subsequent to a packer setting pressure introduced into a wellbore, the piston being configured to prevent the perforator from penetrating the membrane in response to the packer setting pressure.

12. An assembly comprising:

a tubing portion having a tubing port configured to allow access of pressure from an internal area of the tubing portion to an external area;

an outer housing external to the tubing portion having the tubing port, the outer housing comprising a housing opening and defining a flow path between the outer housing and the tubing port;

a perforator disposed in the flow path in a fixed position;

a membrane disposed in the flow path, the membrane being configured for providing a pressure seal and preventing fluid flow in the flow path in response to a packer setting pressure; and a piston disposed in the flow path and coupled to the membrane, the piston being configured for allowing the membrane to move toward the perforator in response to the pressure being above a threshold, the perforator being configured for perforating the membrane in response to the membrane moving toward the perforator, the perforated membrane being configured for allowing fluid flow through the flow path.

13. The assembly of claim 12, wherein the perforator comprises:

a base coupled to the outer housing, the base comprising a base opening; and an elongated member extending from the base.

14. The assembly of claim 13, further comprising:

a spring disposed in the flow path, the spring being configured for biasing at least part of each of the piston and the membrane away from the base subsequent to the elongated member perforating the membrane.

15. The assembly of claim 12, further comprising:

a shear pin coupling the piston to the outer housing prior to the perforator perforating the membrane; and at least one sealing member configured for preventing pressure equalization in the outer housing and for allowing a second flow control assembly to be set.

* * * * *